US007931067B2

(12) United States Patent
Goodman et al.

(10) Patent No.: US 7,931,067 B2
(45) Date of Patent: Apr. 26, 2011

(54) MOVABLE PARTITIONS WITH LATERAL RESTRAINT DEVICES AND RELATED METHODS

(75) Inventors: E. Carl Goodman, Bountiful, UT (US); Daniel L. Steadman, Springville, UT (US)

(73) Assignee: Won-Door Corporation, Salt Lake City, UT (US)

( * ) Notice: Subject to any disclaimer, the term of this patent is extended or adjusted under 35 U.S.C. 154(b) by 653 days.

(21) Appl. No.: 11/934,566

(22) Filed: Nov. 2, 2007

(65) Prior Publication Data

US 2008/0105389 A1 May 8, 2008

Related U.S. Application Data

(60) Provisional application No. 60/856,597, filed on Nov. 3, 2006.

(51) Int. Cl.
*E06B 3/94* (2006.01)

(52) U.S. Cl. ..... 160/84.08; 160/199; 16/365

(58) Field of Classification Search ..... 160/84.08, 160/84.09, 84.11, 118, 199, 206; 16/380, 16/365, 381, 354
See application file for complete search history.

(56) References Cited

U.S. PATENT DOCUMENTS

| | | | | |
|---|---|---|---|---|
| 1,205,707 | A * | 11/1916 | Cahill | 160/199 |
| 1,595,668 | A | 8/1926 | Kuhl | |
| 2,027,992 | A * | 1/1936 | Maurer | 160/159 |
| 2,043,981 | A | 6/1936 | Bickel | |
| 2,151,033 | A | 3/1939 | Jones | |
| 2,736,373 | A | 2/1956 | Truesdale | |
| 2,915,115 | A | 12/1959 | Reynolds | |
| 3,082,817 | A | 3/1963 | Merrill | |
| 3,133,589 | A * | 5/1964 | Harris | 160/84.11 |
| 3,223,147 | A | 12/1965 | Holloway | |
| 3,348,628 | A | 10/1967 | Dixon et al. | |
| 3,389,741 | A | 6/1968 | Bean | |
| 3,447,584 | A | 6/1969 | Smart | |
| 3,481,388 | A | 12/1969 | Smart | |
| 3,509,934 | A | 5/1970 | Smart | |
| 3,577,679 | A | 5/1971 | Petterborg | |

(Continued)

FOREIGN PATENT DOCUMENTS

DE 2506469 8/1975

(Continued)

OTHER PUBLICATIONS

PCT International Search Report for Application No. PCT/US2008/061167, dated Oct. 14, 2008.

(Continued)

*Primary Examiner* — David Purol
(74) *Attorney, Agent, or Firm* — TraskBritt

(57) ABSTRACT

Methods and apparatuses are disclosed for laterally restraining a movable partition. In one embodiment, a movable partition includes two laterally spaced structures wherein each structure includes a plurality of hingedly coupled panels. A lateral restraint mechanism is located and configured to prevent lateral displacement of one or both of the two laterally spaced structures. In one embodiment, at least one bracket is substantially rigidly coupled to a hinge of the first structure and a laterally adjacent hinge of the second structure. The at least one bracket may include multiple brackets. Some described methods include a laterally restraining lower edge of a movable partition as well as the installation of lateral restraint brackets including the plumbing, spacing and squaring of the structures in conjunction with such installation.

21 Claims, 7 Drawing Sheets

U.S. PATENT DOCUMENTS

| | | | | | |
|---|---|---|---|---|---|
| 3,720,254 | A | | 3/1973 | Smart | |
| 3,850,223 | A | * | 11/1974 | Tompkins | 160/84.08 |
| 3,972,381 | A | | 8/1976 | Gail | |
| 3,979,861 | A | | 9/1976 | Fromme et al. | |
| 4,014,072 | A | | 3/1977 | Schumacher | |
| 4,133,364 | A | | 1/1979 | Smart | |
| 4,154,280 | A | | 5/1979 | Hashimoto | |
| 4,172,423 | A | | 10/1979 | Monne | |
| 4,658,878 | A | | 4/1987 | Williams | |
| 4,763,712 | A | * | 8/1988 | van der Klaauw | 160/84.08 |
| 4,852,628 | A | | 8/1989 | Klein | |
| 4,867,221 | A | * | 9/1989 | Dixon et al. | 160/84.08 |
| 4,887,659 | A | | 12/1989 | West | |
| 4,922,987 | A | | 5/1990 | Marontate et al. | |
| 4,932,455 | A | | 6/1990 | Yamada | |
| 4,957,600 | A | | 9/1990 | Carlson et al. | |
| 5,025,846 | A | | 6/1991 | West | |
| 5,065,807 | A | | 11/1991 | Maeda et al. | |
| 5,143,137 | A | | 9/1992 | West | |
| 5,295,527 | A | | 3/1994 | West | |
| 5,411,072 | A | | 5/1995 | Starck et al. | |
| 5,456,303 | A | | 10/1995 | Horinouchi | |
| 5,477,902 | A | | 12/1995 | Kraeutler | |
| 5,542,460 | A | | 8/1996 | McKeon | |
| 5,577,348 | A | | 11/1996 | Keller | |
| 5,749,407 | A | | 5/1998 | Brenner et al. | |
| 5,828,972 | A | | 10/1998 | Asanuma et al. | |
| 5,947,178 | A | | 9/1999 | Patten | |
| 6,035,918 | A | | 3/2000 | Kraeutler | |
| 6,209,171 | B1 | | 4/2001 | Pelletier et al. | |
| 6,223,804 | B1 | | 5/2001 | Toti | |
| 6,267,169 | B1 | | 7/2001 | McDonald | |
| 6,283,189 | B1 | | 9/2001 | Liebscher | |
| 6,378,440 | B1 | | 4/2002 | Rhodes | |
| 6,601,637 | B2 | | 8/2003 | Toti | |
| 6,615,894 | B1 | | 9/2003 | McKeon | |
| 6,662,848 | B2 | | 12/2003 | Goodman et al. | |
| 6,708,094 | B2 | | 3/2004 | Charaudeau et al. | |
| 6,766,847 | B1 | | 7/2004 | Wang | |
| 7,478,663 | B2 | | 1/2009 | Goodman | |
| 7,513,293 | B2 | | 4/2009 | Goodman | |
| 7,740,046 | B2 | | 6/2010 | Goodman et al. | |
| 2003/0226645 | A1 | | 12/2003 | Toti | |
| 2005/0217802 | A1 | | 10/2005 | Goodman et al. | |
| 2007/0152427 | A1 | | 7/2007 | Olsen | |
| 2008/0105387 | A1 | | 5/2008 | Coleman et al. | |
| 2008/0115896 | A1 | | 5/2008 | Goodman | |
| 2008/0169069 | A1 | | 7/2008 | Coleman et al. | |
| 2008/0264578 | A1 | | 10/2008 | Goodman et al. | |
| 2009/0188633 | A1 | | 7/2009 | Goodman et al. | |

FOREIGN PATENT DOCUMENTS

| | | | |
|---|---|---|---|
| DE | 2755157 | | 6/1979 |
| DE | 29506707 | | 7/1995 |
| DE | 20 2005 000 165 | | 3/2006 |
| EP | 0111962 | A1 | 6/1984 |
| EP | 1630337 | | 1/2006 |
| GB | 1226442 | | 3/1971 |
| WO | 2005098189 | A1 | 10/2005 |

OTHER PUBLICATIONS

PCT International Search Report for Application No. PCT/US2008/085504 dated Feb. 24, 2009.

PCT International Search Report and Written Opinion for Application No. PCT/US2007/083520, dated Mar. 25, 2008, 14 pages.

PCT International Search Report for Application PCT/US2007/083526, dated Oct. 7, 2008.

PCT International Search Report and Written Opinion for PCT/2008/050873 dated Oct. 7, 2008.

PCT Written Opinion for Application No. PCT/US2008/061167 dated Oct. 14, 2008.

PCT Written Opinion for Application No. PCT/US2008/085504 dated Feb. 24, 2009.

PCT Written Opinion for Application No. PCT/US2007/083526 dated Oct. 7 2008.

* cited by examiner

MOVABLE PARTITIONS WITH LATERAL RESTRAINT DEVICES AND RELATED METHODS

CROSS-REFERENCE TO RELATED APPLICATION

This application claims the benefit under 35 U.S.C. §119 (e) of U.S. Provisional Application No. 60/856,597, filed Nov. 3, 2006, the disclosure of which is incorporated by reference herein in its entirety.

TECHNICAL FIELD

The present invention relates to movable partitions and, more particularly, to systems, apparatuses and methods for preventing lateral displacement of one or more portions of such partitions.

BACKGROUND

Movable partitions are utilized in numerous situations and environments for a variety of purposes. Such partitions may include for example, foldable or collapsible doors configured to close off an opening in order to enclose a room or to subdivide a single large room into one or more smaller rooms. The subdivision of a larger area may be desired, for example, to accommodate the simultaneous meeting of multiple groups. In such applications movable partitions are useful, among other things, for providing privacy and noise reduction.

Movable partitions may also be used to act as a security barrier, a fire barrier or as both. In such a case, the movable partition may be configured to automatically close upon the occurrence of a predetermined event such as the actuation of an associated alarm. For example, one or more movable partitions may be configured as a fire door or barrier wherein each door is formed with a plurality of panels connected to each other by way of hinge mechanisms. The hinged connection of the panels allows the door to fold-up in a compact unit on one side of the opening or it may be stored in a pocket formed within a wall and being designed to conceal the door and preserve the aesthetics of the room where the door is installed. When deployment of the door is necessary, the door is driven by a motor along a track (the track often being incorporated into the header above the door), until the leading edge of the door, often defined by a component called a lead post, complementarily engages a mating receptacle. Such a mating receptacle may be referred to as a jamb or a door post when formed in a fixed structure (such as a wall), or as mating lead post when formed in another door or movable partition. The lead post, when properly engaged with the doorjamb (or the mating lead post), allows corresponding latching mechanisms to engage if desired, and helps to provide a desired seal (e.g., a seal with respect to airflow, sound waves or both).

However, even when a movable partition is properly closed, the door seal may be broken, for example, if the lower edge of the door is laterally displaced relative to the top edge of the door. Such lateral displacement of the lower edge of the door can be caused, for example, by a draft created by a fire, an improperly balanced HVAC system, or simply a person pushing on the door. When the seal is broken, smoke and flames may intrude around the door if the door is being used as a fire barrier. If the door is being used in a security installation, a person may sufficiently displace the door to enable that person, or another, to slide or crawl underneath the door. At a minimum, displacement of the base of the door is unsightly and significantly reduces the door's effectiveness as a privacy screen and noise barrier.

One approach to preventing or controlling the lateral displacement of a door, including the door's lower edge, is to engage the lower edge of the door in a guide track that is either embedded in or otherwise attached to the floor. However, the use of a track can present various issues. For example, a track disposed in the floor can pose a safety issue, regardless of whether it protrudes above the floor or is recessed within the floor, potentially resulting in a person twisting an ankle or tripping and falling. Likewise, such a track may act as a significant obstacle for wheeled conveyances. Additionally, such a guide track, being exposed when the associated door is in a retracted state, is prone to damage and may act as a collection point for dirt and debris.

It is a desire within the art to continually improve the operation of movable partitions. As such, apparatuses and systems are provided herein to substantially secure a movable partition from lateral displacement. In certain embodiments, methods, apparatuses and systems are provided that substantially maintain the lateral position of a lower edge of a movable partition in order to maintain a seal formed by the partition without the need to employ a track or other structure disposed within a floor over which the partition traverses.

BRIEF SUMMARY OF THE INVENTION

In accordance with various aspects and embodiments of the present invention, movable partitions, lateral restraints for movable partitions and related methods are provided. For example, in one embodiment of the present invention, a movable partition is provided. The movable partition includes a first structure having a first plurality of hingedly coupled panels.

The first structure is supported from an overhead track at a first location. The movable partition further includes a second structure having a second plurality of hingedly coupled panels. The second structure is supported from the overhead track from a second location, the second location being laterally spaced from the first location. A substantially rigid structure is coupled to a first hinge of the first structure and a laterally adjacent hinge of the second structure. In one embodiment, the substantially rigid structure may include one or more brackets.

In accordance with another embodiment of the present invention, a method is provided of restraining lateral displacement of a movable partition. The method includes suspending a first structure from a support structure, the first structure including a first plurality of hingedly coupled panels. A second structure is suspended from the support structure at a laterally spaced location relative to the first structure, the second structure including a second plurality of hingedly coupled panels. A first hinge of the first structure is substantially rigidly coupled with a laterally adjacent hinge of the second structure at a location adjacent the lower edges of the first and second structures.

In accordance with another embodiment of the present invention, another movable partition is provided. The partition includes at least one structure having a plurality of panels, each panel being hingedly coupled to an adjacent panel. The at least one structure is supported from an overhead track. A first bracket is coupled to a first hinge of the at least one structure. The first bracket includes an abutment portion extending adjacent the first hinge and at least one panel that is associated with the first hinge along a lower edge of the at least one structure. A second bracket is also coupled to the first hinge. The second bracket includes an abutment portion extending adjacent the first hinge and the at least one associated panel along an upper edge of the at least one structure. The first bracket and the second bracket are sized, oriented and configured to limit sliding displacement of the first hinge relative to the at least one associated panel.

Other and different features and acts may be included in association with movable partitions and methods of operating such partitions will be apparent to those of ordinary skill in the art upon reading the detailed disclosure and the appended claims.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
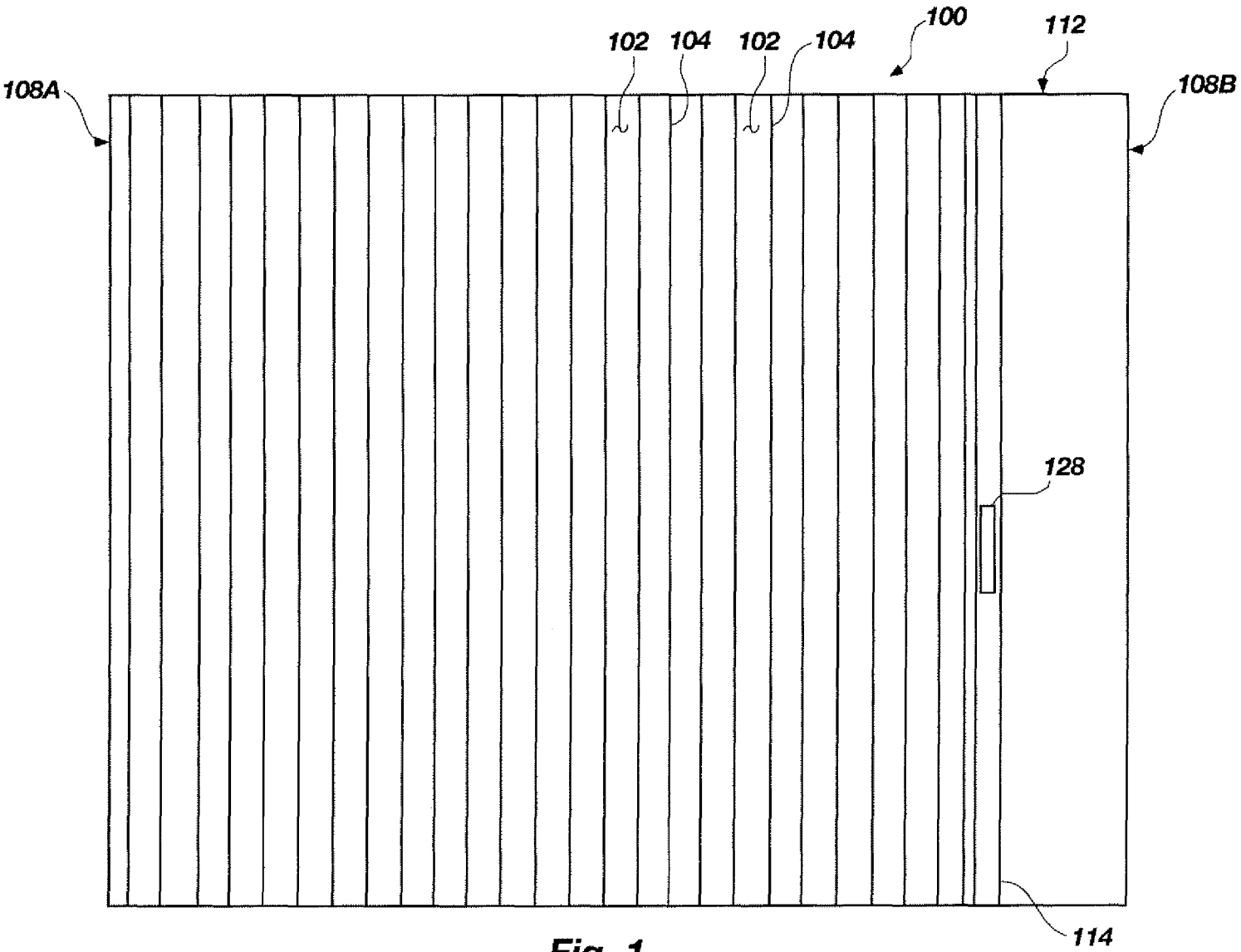
FIG. 1 is an elevation view of a movable partition in accordance with one embodiment of the present invention.
Figure 2:
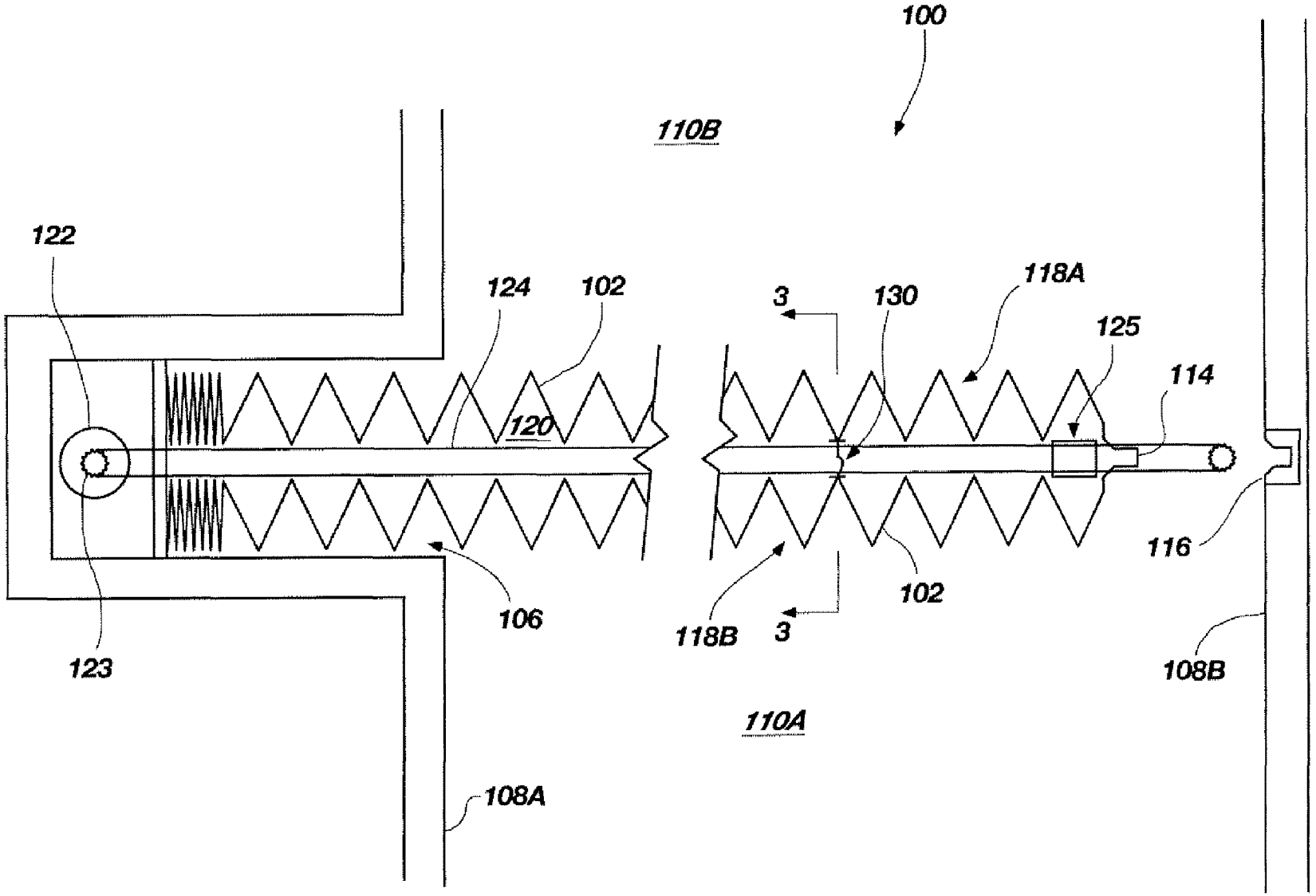
FIG. 2 is a plan view of the movable partition shown in FIG. 1.

Referring to FIGS. 1 and 2, an elevation view and a plan view are shown, respectively, of a movable partition 100. In the example shown in FIGS. 1 and 2, the partition 100 may be in the form of folding door. In certain embodiments, the partition 100 may be used, for example, as a security door, a fire barrier or as both. In other embodiments, the partition need not be utilized as a fire or security barrier, but may be used, for example, to subdivide a larger space into smaller rooms or areas or it may be used as a sound barrier.

The partition 100 may be formed with a plurality of panels 102 that are connected to one another with hinges 104 or other hinge-like structures in an alternating pattern of panel 102 and hinge 104. The hinged connection of the individual panels 102 enables the panels to fold relative to each other in an accordion or a plicated manner such that the partition 100 may be compactly stored, such as in a pocket 106 formed in a wall 108A of a building when the partition is in a retracted or folded state.

When in a deployed state, the partition 100 may extend from one wall 108A to a second wall 108B to act as a barrier (e.g., a fire or security barrier) or to divide one area or room into multiple rooms 110A and 110B. When it is desired to deploy the partition 100 from a stowed condition to an extended position, for example, to secure an area during a fire, the partition 100 may be motivated along an overhead track 112 across the space to provide an appropriate barrier. When in a deployed or an extended state, a leading edge of the partition 100, shown as a male lead post 114, may complementarily or matingly engage with a jamb or door post 116 that may, for example, be formed in a wall 108B of a building.

As best seen in FIG. 2, the partition 100 may include a first barrier or structure 118A and a second barrier or structure 118B, each including a plurality of panels 102 coupled with one another by way of hinges 104 or hinge-like structures. The second structure 118B is laterally spaced from the first structure 118A. Such a configuration may be utilized, for example, as a fire door wherein one structure (e.g., structure 118A) acts as a primary fire and smoke barrier, the space 120 between the two structures 118A and 118B acts as an insulator or a buffer zone, and the other structure (e.g., structure 118B) acts as a secondary fire and smoke barrier. Such a configuration may also be useful in providing an acoustical barrier when the partition is used to subdivide a larger space into multiple, smaller rooms.

It is noted that the structures 118A and 118B are each individually suspended from the overhead track 112. In other words, the track 112 may have multiple elongated channels formed therein such that one structure 118A is suspended from, and longitudinally displaced along, a first channel while the second structure 118B is suspended from, and longitudinally displaced along, a second, separate channel. In another embodiment, multiple individual tracks may be located in or on the ceiling or other supporting structure.

Various means may be used to displace the partition 100 from a stowed condition to a deployed condition and vice versa. For example, depending on the intended use of the partition 100, it may be displaced manually (i.e., by an individual pushing or pulling it along the track 112). In another embodiment, an appropriate actuator may be used to displace the partition 100.

For example, a drive may be used to motivate the partition 100 between a deployed and a retracted state or vice versa. In one embodiment, such a drive may include a motor 122 coupled to a pulley or gear 123 configured to drive a transmission member such as a belt or chain 124. A portion of the belt or chain 124 may be coupled to a trolley 125 that is configured to ride along the track 112. The trolley 125 may be coupled to a component of the partition 100 such as, for example, the lead post 114. Thus, actuation of the motor 122 and belt or chain 124 in a first direction results in displacement of the trolley 125 and lead post 114 so that the partition 100 may be deployed. Actuation of the motor 122 and belt or chain 124 in a second direction results in displacement of the trolley 125 and lead post 114 so that the partition may be retracted.

Additionally, while not specifically shown, various sensors and switches may be employed in association with such a drive to assist in the control of the partition 100. For example, as shown in FIG. 1, the partition 100 may include a switch or actuator 128, sometimes referred to as "panic hardware." Actuation of the panic hardware 128 enables a person located on one side of the partition 100 (e.g., in room 110A) to cause the partition 100 to open if it is closed, or to stop while it is closing, so as to provide access through the barrier formed by the partition 100 for a predetermined amount of time.

It is noted that, while the above description has been directed more specifically to an embodiment including a single partition 100 extending from one wall 108A to another wall 108B, other configurations of movable partitions may be utilized. For example, a two-door, or bi-part partition configuration may be utilized wherein two similarly configured partitions extend across a space and join together to form an appropriate barrier as will be appreciated by those of ordinary skill in the art. In other embodiments, a multi-part configuration may be employed wherein multiple partitions join at a central door post when each is in an extended state.

While the upper portion of the structures 118A and 118B are substantially restrained from lateral displacement due to their slidable coupling with the track 112 (or tracks), the lower edges of the partitions, if not properly restrained, may be laterally displaced such that a substantial gap may be formed between the lower edges of the structures 118A and 118B and the floor or other surface over which they pass. As previously discussed, such displacement may occur due to, for example, a draft from a fire, an imbalanced HVAC (heating, ventilation and air conditioning) system, or from other external force being applied to one of the structures 118A and 118B. To prevent, or at least minimize such lateral displacement, one or more lateral restraint devices 130 may be associated with the movable partition 100.

Figure 3:
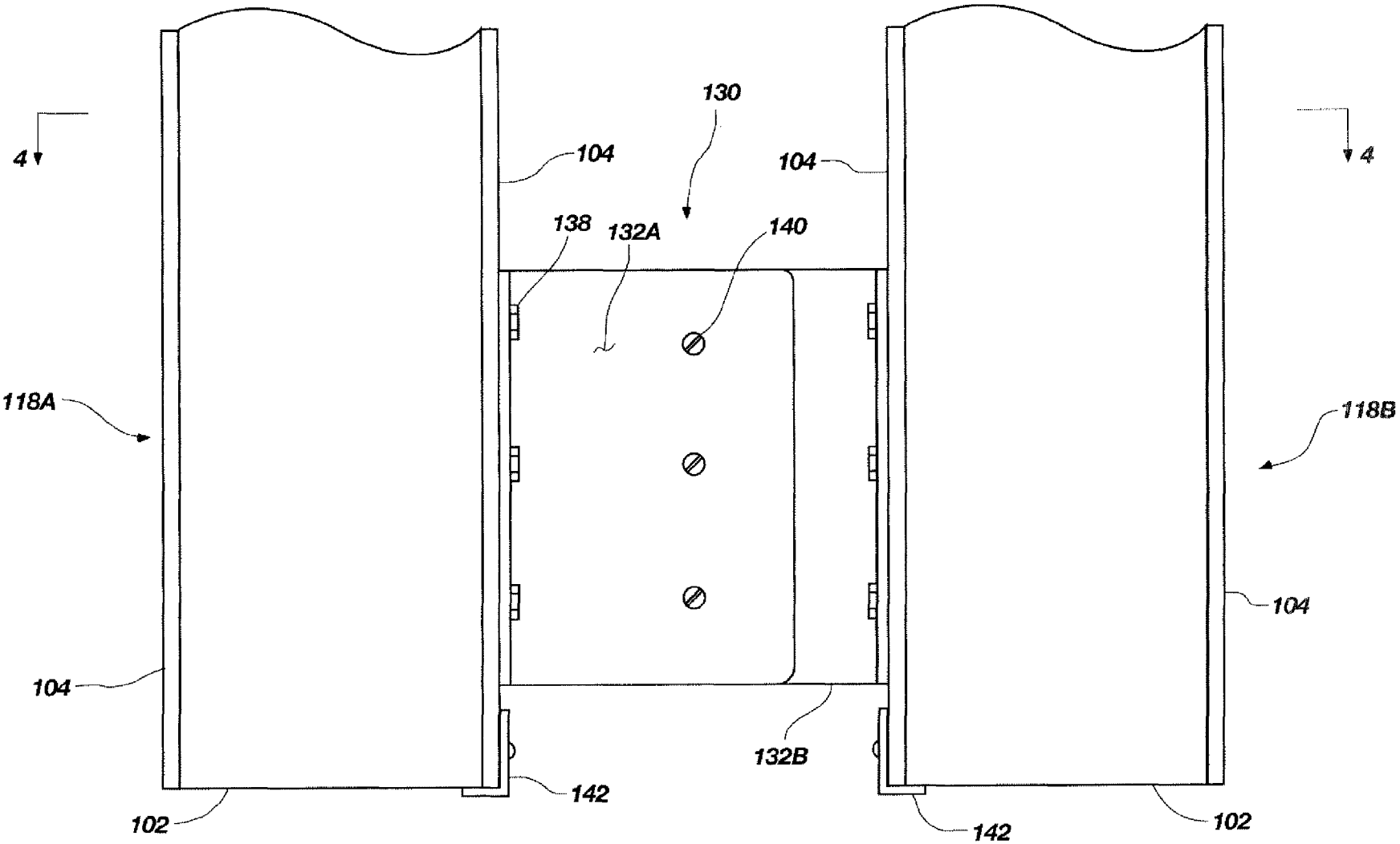
FIG. 3 is a partial cross section of the movable partition shown in FIGS. 1 and 2 as taken along the lines 3-3 in FIG. 2.
Figure 4:
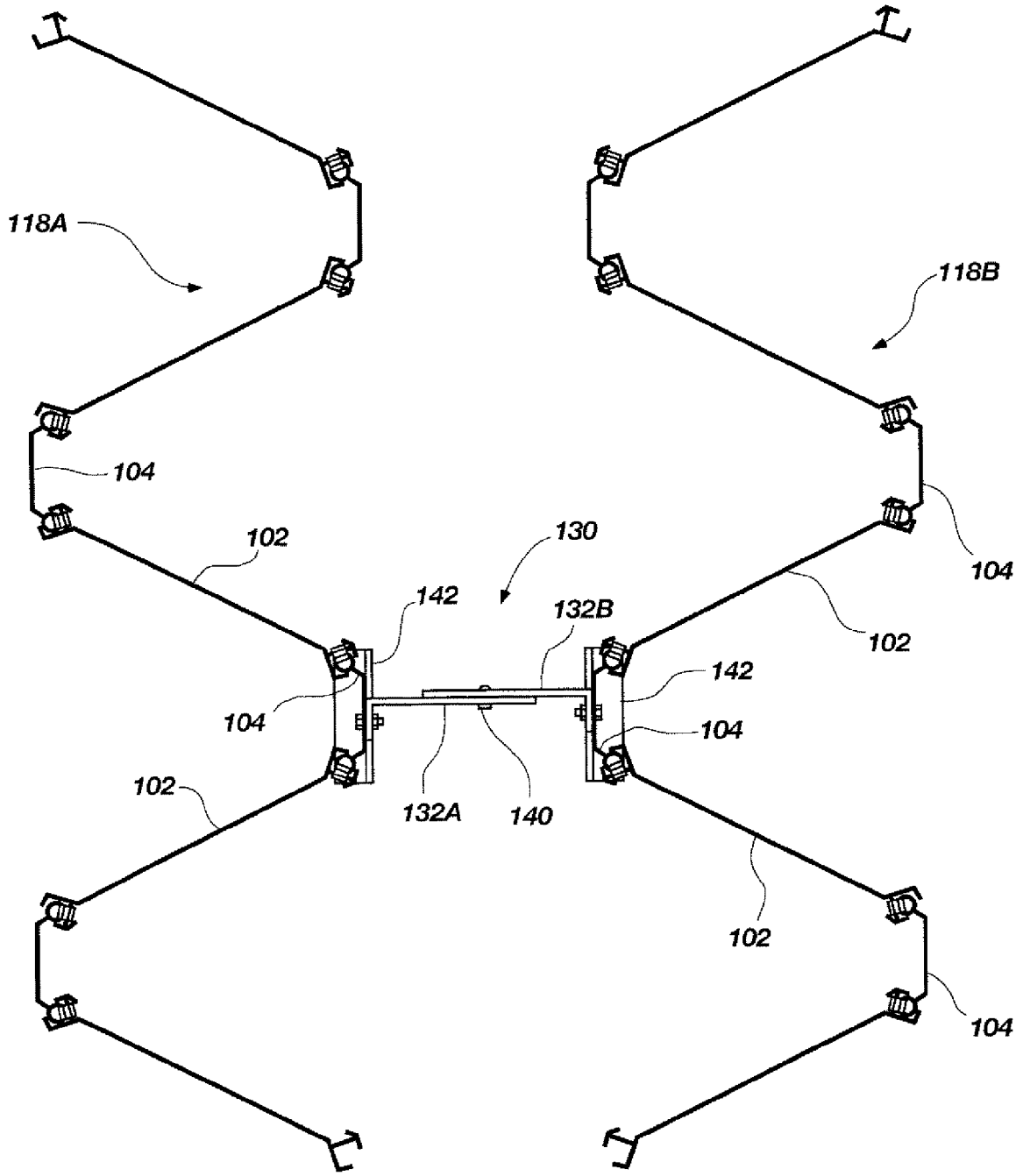
FIG. 4 is a partial cross-sectional view of the movable partition shown in FIGS. 1 through 3 as taken along lines 4-4 in FIG. 3.

Referring to FIGS. 3 and 4, with continued general reference to FIGS. 1 and 2, a lateral restraint device 130, in accordance with one embodiment of the present invention, may include a structure or an assembly coupled between a first hinge 104 associated with the first structure 118A and a laterally adjacent hinge 104 associated with the second structure 118B. The lateral restraint device 130 substantially rigidly couples the lower edge of the structures 118A and 118B to one another.

For example, the lateral restraint device 130 may include a first bracket 132A or frame member coupled to a hinge 104 of the first structure 118A. Additionally, a second bracket 132B or frame member may be coupled to a hinge 104 of the second structure 1118B. The two brackets 132A and 132B or frame members may then be coupled to each other to form a substantially rigid structural member. The brackets 132A, 132B may be coupled together by way of, for example, mechanical fasteners 140 (e.g., screws, rivets), by use of adhesive, by brazing, welding, or by other appropriate means recognized in the art. When installed between the two structures 118A and 118B, the rigid coupling formed between structures 118A and 118B, by way of the lateral restraint device 130, serves to resist any substantial lateral displacement of the structures 118A and 118B when a lateral force is applied to either (or both) of the structures 118A or 118B.

Figure 5:
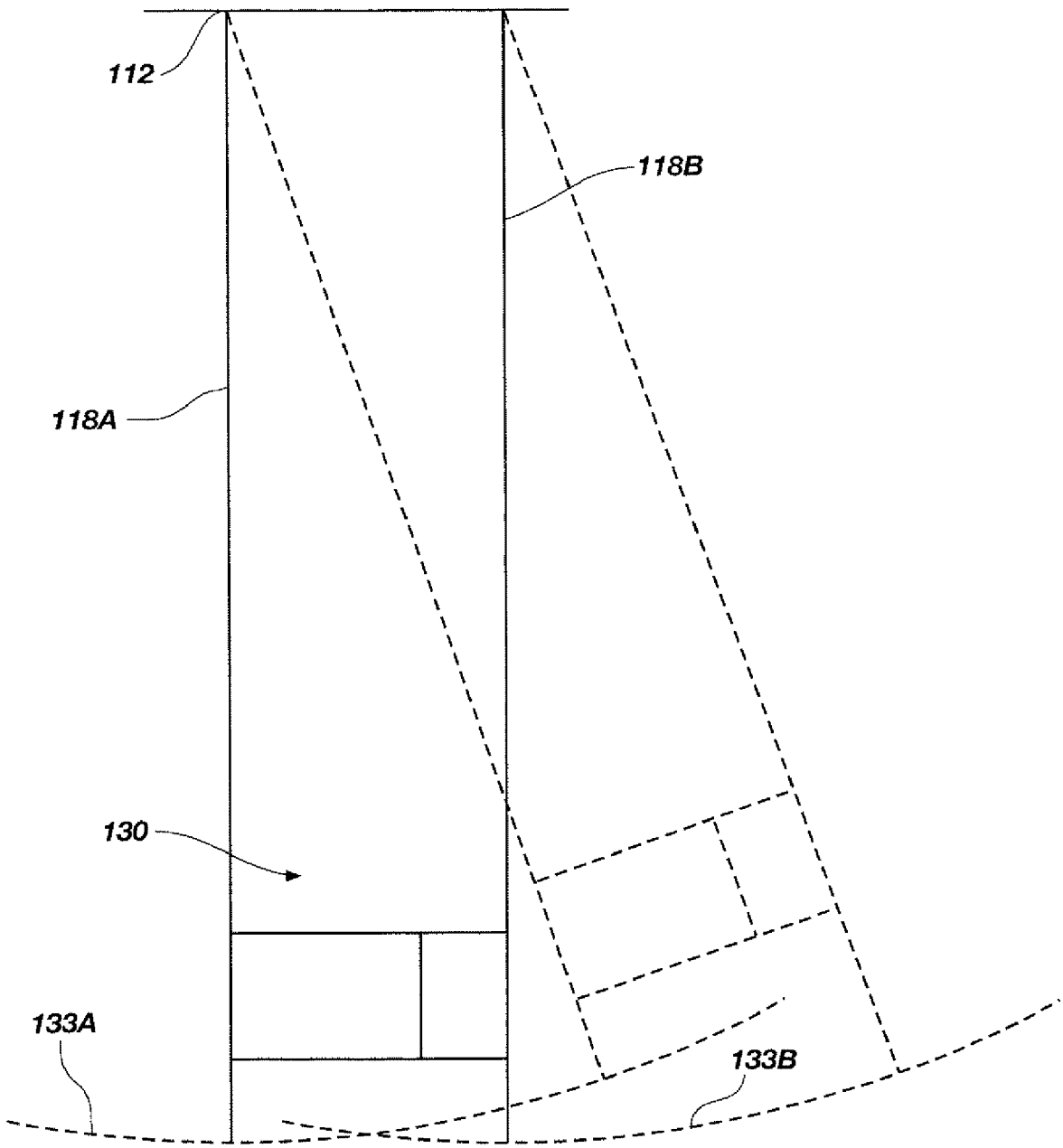
FIG. 5 is a schematic showing certain geometric relationships of a movable partition.

Referring briefly to FIG. 5, a schematic is shown with regard to potential lateral displacement of the first and second structures 118A and 118B of a movable partition 100. As previously described, the first and second structures 118A and 118B are suspended from a track 112 in such a manner that the first and second structures 118A and 118B do not experience any substantial lateral displaced at the upper edges thereof. However, as also previously discussed, the first and second structures 118A and 118B may pivot relative to the track 112 if a lateral restraint device is not employed. Thus, for example, without some form of lateral restraint, the first structure 118A may pivot through an arc 133A such that the lower edge thereof is laterally displaced. Likewise (without use of a lateral restrain device), the second structure 118B may pivot through an arc 133B such the lower edge thereof is laterally displaced. FIG. 5 shows that, if for example, a lateral restraint device 130 was rigidly coupled with the first structure 118A, but not rigidly coupled with the second structure 118B, the first and second structures 118A and 118B could pivot through their respective arcs 133A and 133B, but the lateral restraint device 130 would have to slide relative to second structure 118B in order to accommodate such pivoting and lateral displacement of the lower edges of the first and second structures 118A and 118B. This is evident by the fact that, in the schematic, the position of the lateral restraint device 130 relative to the lower edge of the second structure 118B has changed as the first and second structures 118A and 118B have transitioned from a substantially vertical orientation to a pivoted orientation (the lateral restraint device 130 remaining fixed relative to the first structure 118A in both positions).

Thus, the substantially rigid coupling of the lateral restraint device 130 to each of the first structure 118A and 118B prevents such pivoting thereof and, thus, prevents the lateral displacement of the lower edges of each of the first and second structures 118A and 118B.

Figure 6A:
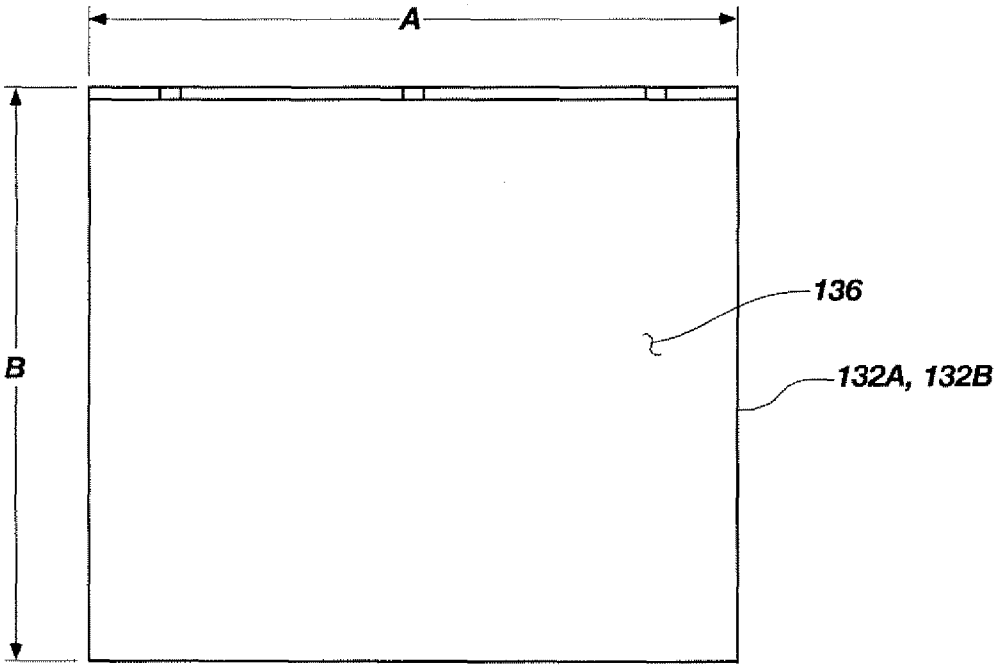
FIGS. 6A-6C show a top view, an end view and a side view, respectively, of a component used in conjunction with preventing lateral displacement of a movable partition in accordance with an embodiment of the present invention.
Figure 6B:
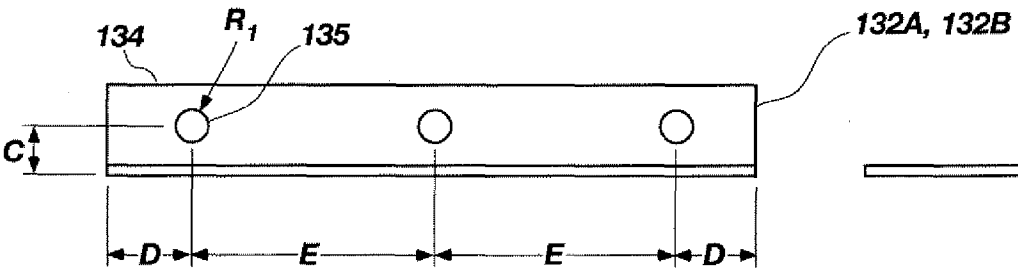
Figure 6C:
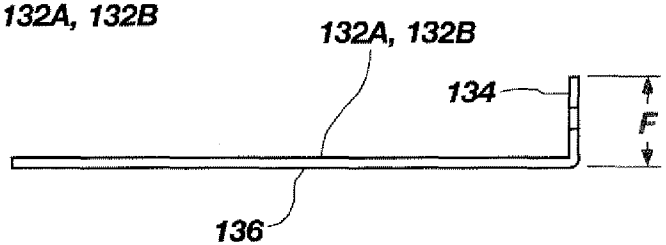

Referring briefly to FIGS. 6A through 6C, an example of a bracket 132A (or 132B) or frame member is shown. The bracket 132A may include an L-shaped member having a first leg 134 configured for attachment to a hinge 104 and a second leg 136 configured for attachment to another bracket (e.g., 132B). In one particular embodiment, the bracket 132A, 132B may be formed to exhibit the following dimensions: dimension A may be approximately 4 inches (approximately 10.2 centimeters); dimension B may be approximately 3.45 inches (approximately 8.8 centimeters); dimension C may be approximately 0.3 inch (approximately 7.6 millimeters); dimension D may be approximately 0.5 inch (approximately 12.7 millimeters); dimension E may be approximately 1.5 inches (approximately 3.8 centimeters); dimension F may be approximately 0.55 inch (approximately 14 millimeters) and the radius $R_1$ of the fastener holes 135 may be approximately 0.188 inch (approximately 0.48 millimeter). Such dimensions are merely example dimensions of one potential embodiment and it is contemplated that other configurations may be utilized.

The brackets 132A and 132B may be made from a variety of materials. For example, the brackets 132A and 132B may be made from materials including metals, metal alloys, plastics, composites or other appropriate materials. The choice of material may depend in part, for example, on the intended used of the partition 100 in which the bracket is incorporated. For example, the use of a partition of a fire door may indicate that a material be used having a relatively high melting point. Appropriate manufacturing processes may be used to form the brackets 132A and 132B depending, for example, on the materials being used as will be appreciated by those of ordinary skill in the art.

In one embodiment of the invention, the lateral restraint device 130 may be installed in a movable partition 100 by following the various acts that are now described with reference back to FIGS. 3 and 4. First, an aperture may be formed in the hinge 104 and the bracket 132A may be attached to the hinge 104 of the first structure 118A using a fastener 138 such as, for example, a rivet, a bolt or a screw through the center hole in the first leg 134 (see FIGS. 6A-6C). The fastener holds the bracket 132A in place while additional holes are drilled or otherwise formed in the hinge 104 corresponding to the remaining holes in the first leg 134. Fasteners 138 are then placed through the remaining holes in the first leg 134 to more securely fasten the bracket 132A to the hinge 104. The second bracket 132B is then installed in a similar manner such that it is securely fastened to the hinge 104 of the second structure 118B and such that the second legs 136 of the two brackets 132A and 132B overlap each other.

The hinges 104, to which the brackets 132A and 132B are attached, are spaced apart a desired distance for example, in one embodiment, approximately 3.5 inches (approximately 8.9 centimeters) apart, the structures 118A and 118B are plumbed (i.e., confirmed to be in a true vertical orientation), and the second legs 136 of the two brackets 132A and 132B are clamped to each other to maintain the established relationship of the two hinges 104 while the two brackets 132A and 132B are more permanently fastened to one another. Holes may then be drilled in the brackets 132A and 132B and fasteners 140 such as rivets, screws, bolts and the like may be used to fasten the second legs 136 of the brackets 132A and 132B together.

It is noted that various types of fasteners may be used including combinations of various types of fasteners. Additionally, other means of fastening the brackets 132A and 132B to each other and to their respective hinges may be used including the use of adhesive, brazing, welding or other appropriate means depending, for example, on the materials used to make the various components of the movable partition 100 and the materials from which the brackets 132A and 132B are formed.

While a single bracket or frame member may be utilized to couple laterally adjacent hinges 104 of the two structures 118A and 118B, the use of two brackets 132A and 132B, as described above, enables the structures 118A and 118B to be plumbed and squared relative to the environment in which they are installed.

Still referring to FIGS. 3 and 4, additional brackets 142 may be installed to prevent the hinges 104 from sliding relative to the panels 102 upon the application of a lateral force to the structures 118A and 118B. A bracket 142 may be coupled to the hinge 104, such as by a rivet, screw, bolt or other fastening means, and leg 144 (see FIGS. 7A and 7B) of the bracket 142 positioned to extend adjacent the lower edge of the hinge 104 as well as the lower edge of the hinge's associated panel or panels 102. While not specifically shown, a similar bracket may be installed in the same manner at the top of the structures 118A and 118B. Thus, if a lateral force is applied to the structures 118A and 118B, and if there is a tendency for the hinges 104 to slide relative to the panels 102, the brackets 142, which are fixed to the hinges 104, will act as an abutment for the lower edge of the associated panel or panels 102 and will prevent such relative sliding.

Figure 7C:
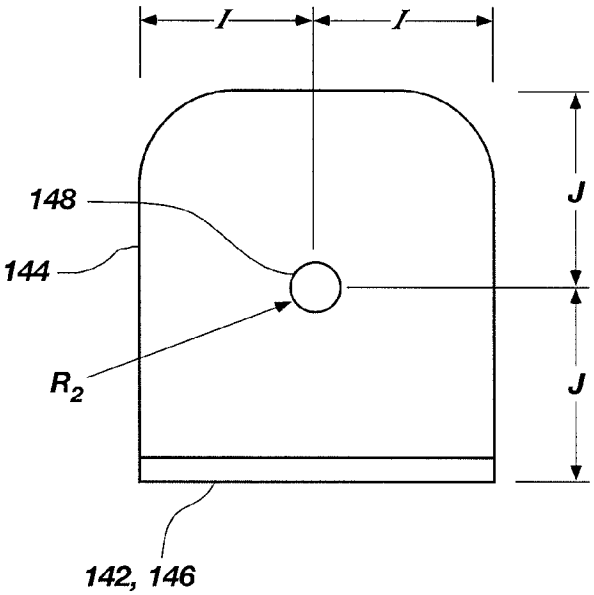
FIGS. 7A-7C show a top view, an end view and a side view, respectively, of a component used in conjunction with preventing lateral displacement of a movable partition in accordance with an embodiment of the present invention.
Figure 7A:
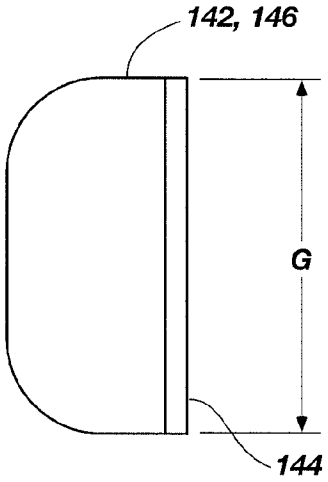
Figure 7B:
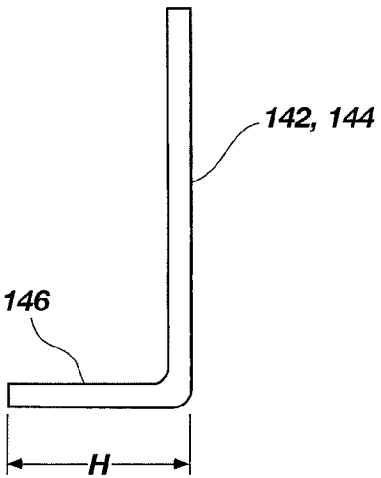

Referring briefly to FIGS. 7A through 7C, an example of a bracket 142 used to prevent relative sliding of the hinges 104 and panels 102 is shown. The bracket 142 may include an L-shaped member having a first leg 144 configured for attachment to a hinge 104 and a second leg 146 configured to extend along the edges of an associated hinge 104 and panel (or panels) 102 (e.g., see FIG. 3). In one particular embodiment, the bracket 142 may be formed to exhibit the following dimensions: dimension G may be approximately 0.9 inch (approximately 2.3 centimeters); dimension H may be approximately 0.47 inch (approximately 1.2 centimeters); dimension I may be approximately 0.45 inch (approximately 1.1 centimeters); dimension J may be approximately 0.5 inch (approximately 1.2 centimeters); the radius $R_2$ of the fastener hole 148 may be approximately 0.129 inch (approximately 3.3 millimeters). Again, the configuration of the bracket 142, shown in FIGS. 7A through 7C, including the dimensions just described, is merely for sake of example and should not be considered limiting in any sense.

The lateral restraint devices 130 may be installed at regular intervals (e.g., every "N" number of hinges) along the length of the movable partition 100. Additionally the brackets 142 used to prevent relative sliding of the hinges 104 and panels 102 may be installed on each of the same hinges to which the lateral restraint devices 130 are installed.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition comprising:

a first structure having a first plurality of panels, each panel being hingedly coupled to an adjacent panel, the first structure being individually suspended from an overhead track at a first location;

a second structure having a second plurality of panels, each panel being hingedly coupled to an adjacent panel, the second structure being individually suspended from the overhead track from a second location, the second location being laterally spaced from the first location; and a substantially rigid structure coupled to a first hinge of the first structure and a laterally adjacent hinge of the second structure;

wherein the first structure includes a first end and a second end, the second structure includes a first end and a second end, and the first end of the first structure and the first end of the second structure are positioned adjacent the overhead track; and wherein the substantially rigid structure is located proximate the second end of the first structure and the second end of the second structure, and remote from the first end of the first structure and the first end of the second structure.

2. The movable partition of claim 1, wherein the substantially rigid structure includes at least one bracket.

3. The movable partition of claim 2, wherein the at least one bracket further includes at a first bracket coupled to the first hinge of the first structure and a second bracket coupled to the laterally adjacent hinge of the second structure wherein the first bracket and the second bracket are substantially rigidly coupled to one another.

4. The movable partition of claim 3, wherein the first bracket is coupled with the first hinge with at least one mechanical fastener and wherein the second bracket is coupled with the laterally adjacent hinge with at least one mechanical fastener.

5. The movable partition of claim 4, wherein the first bracket includes a first leg extending in a first direction and a second leg extending in a substantially perpendicular direction.

6. The movable partition of claim 5, wherein the second bracket includes a first leg extending in a first direction and a second leg extending in a substantially perpendicular direction, and wherein the first leg of the first bracket is coupled to the first hinge, the first leg of the second bracket is coupled to the laterally adjacent hinge, and wherein the second leg of the first bracket and the second leg of the second bracket overlap one another and are coupled to one another.

7. The movable partition of claim 1, further comprising at least one additional substantially rigid structure coupled between the first structure and the second structure wherein the at least one additional substantially rigid structure is located substantially parallel to the substantially rigid structure along a horizontal length of the movable partition.

8. The movable partition of claim 7, wherein the at least one additional substantially rigid structure is coupled with another hinge of the first structure and another hinge of the second structure.

9. The movable partition of claim 1, further comprising:

a first bracket coupled to the first hinge and having an abutment portion extending adjacent the first hinge and at least one panel coupled to the first hinge along the first end of the first structure; and a second bracket coupled to the first hinge and having an abutment portion extending adjacent the first hinge and the at least one panel along the second end of the first structure, the first bracket and the second bracket being sized, oriented and configured to limit sliding displacement of the first hinge relative to the at least one panel.

10. A method of restraining lateral movement of a movable partition, the method comprising:

individually suspending a first structure from a support structure, the first structure including a first plurality of panels wherein each panel is hingedly coupled to an adjacent panel;

individually suspending a second structure from the support structure at a laterally spaced location relative to the first structure, the second structure including a second plurality of hingedly coupled panels; and substantially rigidly coupling a first hinge of the first structure with a laterally adjacent hinge of the second structure at a location adjacent a lower edge of the first structure and a lower edge of the second structure, comprising:

coupling a first bracket to the first hinge;

coupling a second bracket to the laterally adjacent hinge; and directly coupling the first bracket to the second bracket.

11. The method according to claim l0, further comprising spacing the first hinge and the laterally adjacent hinge a preselected distance prior to coupling the first hinge and the laterally adjacent hinge.

12. The method according to claim 10, further comprising plumbing the first structure and the second structure prior to coupling the first hinge and the laterally adjacent hinge.

13. The method according to claim 10, wherein substantially rigidly coupling a first hinge of the first structure with a laterally adjacent hinge of the second structure further comprises:

coupling the second bracket to the laterally adjacent hinge such that a portion of the second bracket overlaps a portion of the first bracket;

spacing the first hinge a desired distance from the laterally adjacent hinge; and plumbing each of the first hinge and the laterally adjacent hinge.

14. The method according to claim 13, wherein coupling the first bracket to the second bracket further comprises:

temporarily clamping overlapping portions of the first bracket and the second bracket;

forming aligned openings in each of the overlapping portions of the first bracket and the second bracket;

disposing a mechanical fastener in the aligned openings; and unclamping the overlapping portions.

15. The method according to claim 10, further comprising limiting any sliding displacement between the first hinge and at least one associated panel to which the first hinge is coupled.

16. The method according to claim 15, wherein limiting any sliding displacement between the first hinge and at least one associated panel includes coupling a first bracket to the first hinge and locating an abutment edge of the bracket to extend along the lower edge of the first structure adjacent the at least one associated panel.

17. The method according to claim 16, further comprising coupling a second bracket to the first hinge and locating an abutment edge of the bracket to extend along an upper edge of the first structure adjacent the at least one associated panel.

18. The method according to claim 10, further comprising substantially rigidly coupling the first structure and the second structure adjacent a lower edge of the first structure and a lower edge of the second structure at least one additional location longitudinally spaced from the first hinge.

19. The method according to claim 18, wherein substantially rigidly coupling the first structure and the second structure adjacent a lower edge of the first structure and a lower edge of the second structure at at least one additional location longitudinally spaced from the first hinge further includes substantially rigidly coupling a second hinge of the first structure with another hinge of the second structure.

20. A movable partition comprising:

a first structure having a plurality of panels, each panel being hingedly coupled to an adjacent panel, the first structure being supported from an overhead track;

a second structure having a second plurality of panels, each panel being hingedly coupled to an adjacent panel, the second structure being supported from the overhead track from a second location, the second location being laterally spaced from the first location;

a substantially rigid structure coupled to a first hinge of the first structure and a laterally adjacent hinge of the second structure;

a first bracket coupled to the first hinge of the first structure below the substantially rigid structure, the first bracket having an abutment portion extending along a lower edge of the first structure adjacent the first hinge and at least one panel coupled to the first hinge; and a second bracket coupled to the laterally adjacent hinge of the second structure below the substantially rigid structure, the second bracket having an abutment portion extending along a lower edge of the second structure adjacent the laterally adjacent hinge and at least one panel coupled to the laterally adjacent hinge;

wherein the first bracket and the second bracket are each sized, oriented and configured to limit sliding displacement of the first hinge relative to the at least one panel.

21. The movable partition of claim 20, further comprising:

a third bracket coupled to the first hinge of the first structure above the substantially rigid structure, the third bracket having an abutment portion extending along an upper edge of the first structure adjacent the first hinge and at least one panel coupled to the first hinge; and a fourth bracket coupled to the laterally adjacent hinge of the second structure above the substantially rigid structure, the fourth bracket having an abutment portion extending along an upper edge of the second structure adjacent the laterally adjacent hinge and at least one panel coupled to the laterally adjacent hinge;

wherein the third bracket and fourth bracket are each sized, oriented and configured to limit sliding displacement of the first hinge relative to the at least one panel coupled to the first hinge.

* * * * *